US010640361B1

(12) United States Patent
Chen

(10) Patent No.: US 10,640,361 B1
(45) Date of Patent: May 5, 2020

(54) MANUAL FLUID EXTRACTOR

(71) Applicant: Jiashan Jinzhan Tool Co., Ltd., Jiashan (CN)

(72) Inventor: Jinquan Chen, Jiashan (CN)

(73) Assignee: Jiashan Jinzhan Tool Co., Ltd., Jiashan (CN)

( * ) Notice: Subject to any disclaimer, the term of this patent is extended or adjusted under 35 U.S.C. 154(b) by 0 days.

(21) Appl. No.: 16/164,658

(22) Filed: Oct. 18, 2018

(51) Int. Cl.
*B67D 7/60* (2010.01)
*B67D 7/04* (2010.01)

(52) U.S. Cl.
CPC ..... *B67D 7/60* (2013.01); *B67D 7/04* (2013.01)

(58) Field of Classification Search
CPC ..... B67D 7/60; B67D 7/0205
USPC ..... 222/400.8, 401
See application file for complete search history.

(56) References Cited

U.S. PATENT DOCUMENTS 817,391 A * 4/1906 Robert-Shaw ..... B05B 9/0822 222/401
921,010 A * 5/1909 Sheldon ..... B05B 9/0822 222/401
1,957,735 A * 5/1934 Straub ..... F16N 3/08 222/401
2,811,284 A * 10/1957 Rogers ..... B67D 1/02 222/173
3,623,372 A * 11/1971 Markey ..... G01F 17/00 73/49.7
4,606,477 A * 8/1986 Spengler ..... A47L 11/1625 222/153.09
5,450,924 A * 9/1995 Tseng ..... F01M 11/045 137/202
6,357,492 B1 * 3/2002 Hsu ..... B67D 7/0205 137/565.25
6,463,952 B1 * 10/2002 Stevens ..... B65D 25/42 137/205
7,367,366 B2 * 5/2008 Liao ..... F04B 33/00 141/26
2006/0027608 A1 * 2/2006 Chen ..... F04B 33/00 222/401
2012/0107146 A1 * 5/2012 Hsu ..... F04B 9/14 417/305
2012/0107161 A1 * 5/2012 Sun ..... F04B 9/14 417/482
2012/0275944 A1 * 11/2012 Chuang ..... F04B 9/14 417/442

* cited by examiner

*Primary Examiner* — J C Jacyna
(74) *Attorney, Agent, or Firm* — Schwegman Lundberg & Woessner, P.A.

(57) ABSTRACT

This invention provides a manual fluid extractor which includes a liquid storage barrel, a barrel cover, an inflator, a liquid adding pipe base, a liquid extracting pipe, a liquid adding pipe and a control valve. The barrel cover is connected with the liquid storage barrel in a sealing way, one end of the liquid extracting pipe is connected with the liquid adding pipe base, and the other end is freely located at an interior of the liquid storage barrel. The liquid adding pipe is connected with the liquid adding pipe base, and the liquid adding pipe communicates with the liquid extracting pipe. A control valve is disposed at the liquid adding pipe. This invention reduces complexity of an assembly process, improves product performance and reduces manufacturing costs.

9 Claims, 3 Drawing Sheets

MANUAL FLUID EXTRACTOR

BACKGROUND OF THE INVENTION

Field of the Invention

This invention relates to liquid adding equipment, and more particularly, to a manual fluid extractor used for refueling automobiles.

Description of the Related Art

A traditional designed liquid adding machine, also known as a refueling machine, a refueling barrel, etc., adopts separate structures. Its inflator and oil (liquid) storage barrel are independently manufactured and then both the two are installed: the oil (liquid) storage barrel and a base are connected through screws, the base and the inflator are connected through screws, and the inflator and an air inlet pipe are connected through a quick connector and a nut. This kind of separate structures leads to a large number of involved components, a complicated assembly process, high difficulty for operation, and low reliability of sealing performance among components requiring sealing, which directly leads to high costs for production and maintenance.

BRIEF SUMMARY OF THE INVENTION

To solve problems existed in the prior art, this invention provides a manual fluid extractor.

To achieve above-mentioned objectives, the technical solution adopted by this invention is the manual fluid extractor which includes:

a liquid storage barrel;

a barrel cover connected with the liquid storage barrel in a sealing way;

an inflator including an inflator shell, an inflator rod and a piston assembly, wherein the inflator shell is integrally formed with the liquid storage barrel, the inflator rod is inserted in the inflator shell, the piston assembly is placed in an interior of the inflator shell, the piston assembly is fixedly connected with the inflator rod, and the piston assembly generates an air pressure in the inflator shell under an action of an external force;

an air passage assembly placed inside of the liquid storage barrel, wherein the air passage assembly cooperates with the liquid storage barrel;

a liquid adding pipe base installed at the barrel cover;

a liquid extracting pipe located inside of the liquid storage barrel, wherein one end of the liquid extracting is connected with the liquid adding pipe base, and the other end of the liquid extracting is freely located at a bottom of an interior of the liquid storage barrel;

a liquid adding pipe connected with the liquid adding pipe base, wherein the liquid adding pipe communicates with the liquid extracting pipe; and a control valve disposed at the liquid adding pipe and fixedly connected with the liquid adding pipe.

In one embodiment of this invention, the barrel cover may be provided with a liquid inlet, an opening and closing cover, a pressure relief valve and a pipe base hole. The opening and closing cover may cover on the liquid inlet, the opening and closing cover may be connected with the barrel cover in a sealing way, and the pressure relief valve may communicate with the interior of the liquid storage barrel.

In one embodiment of this invention, the liquid adding pipe base may be located at the pipe base hole on the barrel cover.

In one embodiment of this invention, the liquid extracting pipe may include a hard pipe and a soft pipe, and the hard pipe may communicate with the soft pipe.

In one embodiment of this invention, the air passage assembly may include a first air passage structure, a second air passage structure and a check valve. The first air passage structure may be located at a bottom of the inflator shell, and the second air passage structure may be disposed at an interior of a side wall of the liquid storage barrel. One end of the first air passage structure may communicate with the inflator shell, the other end of the first air passage structure may communicate with the second air passage structure, and the second air passage structure may communicate with the liquid storage barrel through the check valve.

In one embodiment of this invention, the air passage assembly may further include a rubber ball. The first air passage structure may be provided with an air closing hole, and the rubber ball may cooperate with the air closing hole.

In one embodiment of this invention, the second air passage structure may be an air passage opened at the side wall of the liquid storage barrel, and the air passage may be a closed air passage. One end of the air passage may be provided with the check valve, the check valve may be located at the outlet of the air passage, and the other end of the air passage may communicate with the first air passage structure.

In one embodiment of this invention, the check valve may include a spring and a rubber gasket. The spring may cooperate with the rubber gasket, and the rubber gasket may cooperate with the outlet of the air passage.

In one embodiment of this invention, the manual fluid extractor may further include a sealing ring, and the sealing ring may be located between the barrel cover and the liquid storage barrel.

The present invention has the following beneficial effects:

The inflator shell of the inflator and the liquid storage barrel are manufactured through an integral molding way. Through a special design of a special structure of the air passage assembly and an air flow path, the complexity of the assembly is reduced, the sealing performance of the product is improved, and the production cost is reduced. By inflating the gas to the liquid storage barrel through the inflator, a liquid surface in the liquid storage barrel is pressurized, then the liquid is forced into the liquid extracting pipe, and the liquid is extracted to the liquid adding pipe. Under the control of the control valve, it is convenient and reliable to achieve the purpose of extracting the liquid from the liquid storage barrel. Therefore, this invention has advantages of easier operation for manufacture, more reliable performance and more convenient use of the product through the optimized design of the product.

Figure 1:
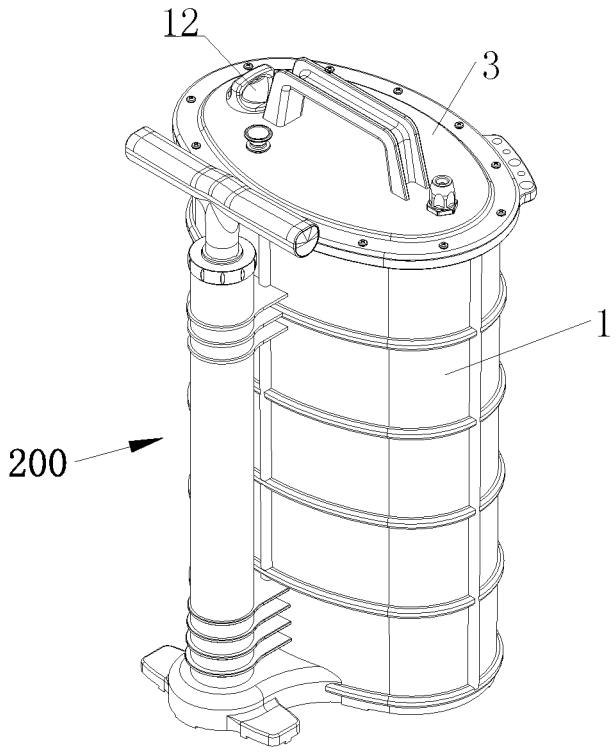
FIG. 1 is a schematic view of one embodiment of the present invention.

Elements in the drawings are marked as below:

1. liquid storage barrel; 2. sealing ring; 3. barrel cover; 6. control valve; 8. liquid adding pipe; 9. liquid extracting pipe;

10. liquid adding pipe base; 11. bolt; 12. opening and closing cover; 13. pressure relief valve; 14. nut; 31. liquid inlet; 32. pipe base hole; 200. inflator; 201. inflator shell; 15. check valve; 151. spring; 152. rubber gasket; 16. inflator rod; 18. piston assembly; 19. rubber ball; 21. air passage assembly; 222. air closing hole; 2101. first air passage structure; 2102. second air passage structure.

DETAILED DESCRIPTION OF THE INVENTION

The following is only a preferred embodiment of the present invention and is not to limit the scope of the invention.

Figure 2:
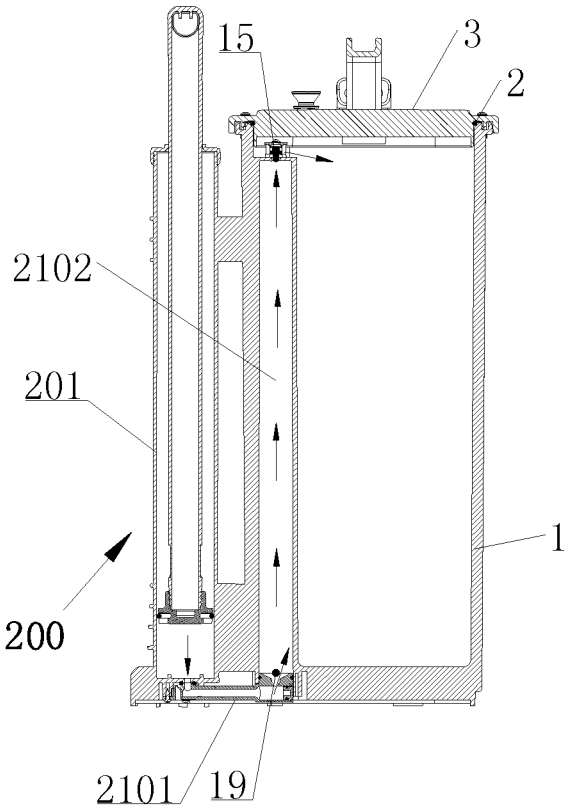
FIG. 2 is a section view of FIG. 1.
Figure 3:
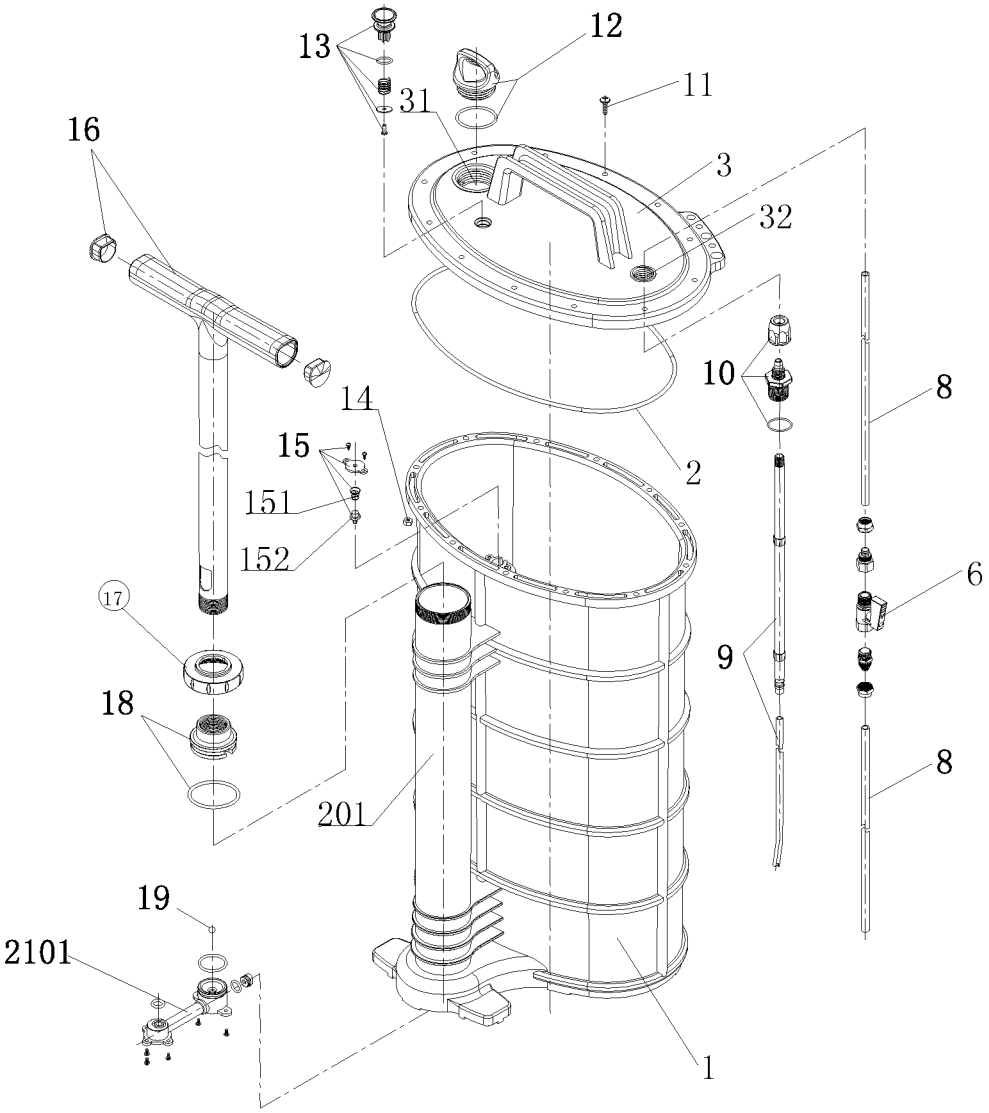
FIG. 3 is an exploded view of one embodiment of the present invention.
Figure 4:
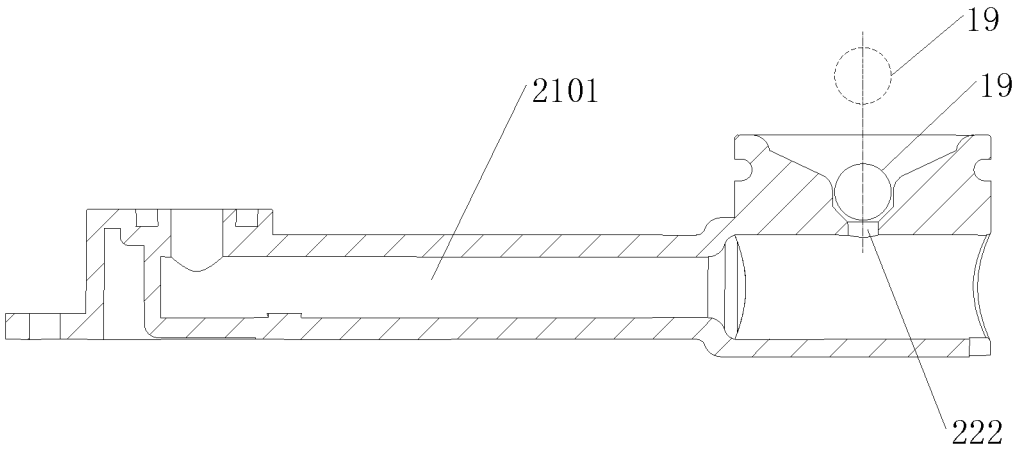
FIG. 4 is a schematic view of air closing by the rubber ball.

A manual fluid extractor, as shown in FIG. 1-4, includes a liquid storage barrel 1, a barrel cover 3, an inflator 200, an air passage assembly 21, a liquid adding pipe base 10, a liquid extracting pipe 9, a liquid adding pipe 8 and a control valve 6. The barrel cover 3 and the liquid storage barrel 1 are connected in a sealing way through a sealing ring 2, and the sealing ring 2 is pressed tightly between the barrel cover 3 and the liquid storage barrel 1 through a bolt 11 and a nut 14. The barrel cover 3 is provided with a liquid inlet 31, an opening and closing cover 12, a pressure relief valve 13 and a pipe base hole 32. The opening and closing cover 12 covers on the liquid inlet 31, the opening and closing cover 12 is connected with the barrel cover 3 in a sealing way, and the pressure relief valve 13 communicates with an interior of the liquid storage barrel 1. The liquid adding pipe base 10 is fixedly installed at the pipe base hole 32 of the barrel cover 3.

An upper end of the liquid extracting pipe 9 is fixedly connected with the liquid adding pipe base 10, and a lower end of the liquid extracting pipe 9 is freely located at the bottom of the interior of the liquid storage barrel 1. The liquid extracting pipe 9 includes two parts: a hard pipe and a soft pipe. The hard pipe communicates with the soft pipe. The liquid extracting pipe 9 plays a role of liquid extraction and extracts the liquid from the liquid storage barrel 1. The liquid adding pipe 8 is fixedly connected with the liquid adding pipe base 10, and the liquid adding pipe 8 communicates with the liquid extracting pipe 9. The liquid adding pipe 8 is provided with a control valve 6, and the control valve 6 is fixedly connected with the liquid adding pipe 8 to control the opening and closing of the control valve 6, that is to control the outflow of the liquid.

The inflator 200 includes an inflator shell 201, an inflator rod 16 and a piston assembly 18. The inflator shell 201 is integrally formed with the liquid storage barrel 1. The inflator rod 16 is inserted in the inflator shell 201. The piston assembly 18 is placed in an interior of the inflator shell 201, and the piston assembly 18 is fixedly connected with the inflator rod 16. The piston assembly 18 generate an air pressure under the action of an external force, and the generated air pressure is transported to the liquid storage barrel 1 through the air passage assembly 21 located at the bottom of the liquid storage barrel 1.

The air passage assembly 21 includes a first air passage structure 2101, a second air passage structure 2102, a check valve 15 and a rubber ball 19. The first air passage structure 2101 is fixedly disposed at the bottom of the inflator shell 201, one end of the first air passage structure 2101 communicates with the inflator shell 201, and the other end of the first air passage structure 2101 communicates with the second air passage structure 2102. In this embodiment, the second air passage structure 2102 is a closed air passage provided inside the wall of the liquid storage barrel 1. One end of the closed air passage near the opening of the liquid storage barrel 1 is provided with the check valve 15, the closed air passage communicates with the interior of the liquid storage barrel 1 through the check valve 15, and the other end of the closed air passage communicates with the first air passage structure 2101. The first air passage structure 2101 is provided with an air closing hole 222. When the inflator 200 is inflating, the rubber ball 19 is blown away from the air closing hole 222 by the gas, at this time, the rubber ball 19 is located at the position shown by the dotted line in FIG. 4 such that the gas can enter the liquid storage barrel 1 through the closed air passage. When the inflator 16 is withdrawn or does not inflate, because of gravity the rubber ball 19 falls into the air closing hole 222 along the slope, that is to say the rubber ball 19 falls down to the position of the rubber ball 19 shown in FIG. 4. A through hole under the air closing hole 222 is closed so as to form an air closing effect.

The check valve 15 is disposed at an outlet of the air passage in the liquid storage barrel 1, and the check valve 15 is higher than the height of the liquid in the liquid storage barrel 1. The check valve 15 includes a spring 151 and a rubber gasket 152. The spring 151 cooperates with the rubber gasket 152, and the size of the rubber gasket 152 matches with the caliber of the outlet of the air passage. When there is gas coming in, the spring 151 shrinks and the gas passes through; and when there is no inflating, the spring 151 presses the rubber gasket 152 against the outlet of the air passage, such that the air passage is isolated from the interior of the liquid storage barrel, and the gas in the liquid storage barrel 1 cannot be get out. Both the check valve 15 and the rubber ball 19 are one direction air closing components. When the inflator 200 is inflating, the rubber ball 19 falls due to gravity, and the positive pressure in the liquid storage barrel 1 presses the rubber ball 19 to close the air. Therefore, a dual air closing function of this product makes the performance of this product more reliable and outstanding.

During usage, required amount of the oil is put into the liquid storage barrel 1, or it may be water or other required liquid, and the liquid inlet is covered tightly by the opening and closing cover 12; then the inflator rod 16 moves repeatedly, under the action of the piston assembly 18, the gas passes through the first air passage structure 2101, the air flow blows the rubber ball 19 away from the air closing hole 222, the air flow passes through the second air passage structure 2102 in the liquid storage barrel 1 and pushes the rubber gasket 152 of the check valve 15 into the liquid storage barrel 1. The air flow is shown in an arrow direction in FIG. 2. Therefore, the pressure in the liquid storage barrel 1 rises. A pressure relief value of the check valve 15 is 1.5 $Kg/cm^2$. After the liquid storage barrel 1 has a certain positive pressure, the liquid adding pipe 8 can be used to add liquid to liquid demanding device, and the control valve 6 is used to control the opening and closing of the liquid adding function.

This invention simplifies the product structure, reduces the assembly difficulty, improves the product performance, at the same time reduces costs of the production, operation, maintenance and sales, and the operation is simple. This invention is suitable for the refueling of commercial and domestic automobiles and can also be used as a car washing tool, a gardening spraying tool and the like.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A manual fluid extractor, comprising:

a liquid storage barrel;

a barrel cover, being connected with the liquid storage barrel in a sealing way;

an inflator, comprising an inflator shell, an inflator rod and a piston assembly, wherein the inflator shell is integrally formed with the liquid storage barrel, the inflator rod is inserted in the inflator shell, the piston assembly is placed in an interior of the inflator shell, the piston assembly is fixedly connected with the inflator rod, and the piston assembly generates an air pressure in the inflator shell under an action of an external force;

an air passage assembly placed inside of the liquid storage barrel, wherein the air passage assembly cooperates with the liquid storage barrel;

a liquid adding pipe base installed at the barrel cover;

a liquid extracting pipe, being located inside of the liquid storage barrel, wherein one end of the liquid extracting is connected with the liquid adding pipe base, and the other end of the liquid extracting is freely located at a bottom of an interior of the liquid storage barrel;

a liquid adding pipe, being connected with the liquid adding pipe base, wherein the liquid adding pipe communicates with the liquid extracting pipe; and a control valve disposed at the liquid adding pipe and fixedly connected with the liquid adding pipe.

2. The manual fluid extractor according to claim 1, wherein the barrel cover is provided with a liquid inlet, an opening and closing cover, a pressure relief valve and a pipe base hole, wherein the opening and closing cover covers on the liquid inlet, the opening and closing cover is connected with the barrel cover in a sealing way, and the pressure relief valve communicates with the interior of the liquid storage barrel.

3. The manual fluid extractor according to claim 2, wherein the liquid adding pipe base is located at the pipe base hole on the barrel cover.

4. The manual fluid extractor according to claim 1, wherein the liquid extracting pipe comprises a hard pipe and a soft pipe, and the hard pipe communicates with the soft pipe.

5. The manual fluid extractor according to claim 1, the air passage assembly comprising a first air passage structure, a second air passage structure and a check valve, wherein the first air passage structure is located at a bottom of the inflator shell, the second air passage structure is disposed at an interior of a side wall of the liquid storage barrel, one end of the first air passage structure communicates with the inflator shell, the other end of the first air passage structure communicates with the second air passage structure, and the second air passage structure communicates with the liquid storage barrel through the check valve.

6. The manual fluid extractor according to claim 5, wherein the air passage assembly further comprises a rubber ball, the first air passage structure is provided with an air closing hole, and the rubber ball cooperates with the air closing hole.

7. The manual fluid extractor according to claim 5, wherein the second air passage structure is an air passage opened at the side wall of the liquid storage barrel, the air passage is a closed air passage, one end of the air passage is provided with the check valve, the check valve is located at the outlet of the air passage, and the other end of the air passage communicates with the first air passage structure.

8. The manual fluid extractor according to claim 7, wherein the check valve comprises a spring and a rubber gasket, the spring cooperates with the rubber gasket, and the rubber gasket cooperates with the outlet of the air passage.

9. The manual fluid extractor according to claim 1, further comprising a sealing ring, wherein the sealing ring is located between the barrel cover and the liquid storage barrel.

* * * * *